US007685856B1

(12) United States Patent
Ghiran et al.

(10) Patent No.: US 7,685,856 B1
(45) Date of Patent: Mar. 30, 2010

(54) TWO MODE HYDROFORM SEAL APPARATUS AND METHOD

(75) Inventors: Mike M. Ghiran, Lake Orion, MI (US); Spyros P. Mellas, Waterford, MI (US); Tiffanie E. Coe, Sterling Heights, MI (US); Kevin R. Marks, Durand, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/268,461

(22) Filed: Nov. 11, 2008

(51) Int. Cl.
*B21D 39/08* (2006.01)
*B23P 17/02* (2006.01)

(52) U.S. Cl. ..... 72/61; 72/58; 72/62; 29/421.1

(58) Field of Classification Search ..... 72/58, 72/59, 61, 62, 370.22; 29/421.1
See application file for complete search history.

(56) References Cited

U.S. PATENT DOCUMENTS 4,393,674 A * 7/1983 Rasmussen ..... 72/61
5,233,854 A * 8/1993 Bowman et al. ..... 72/58
5,357,774 A * 10/1994 Klages et al. ..... 72/62
5,445,002 A * 8/1995 Cudini et al. ..... 72/62
5,511,404 A * 4/1996 Klages et al. ..... 72/62
6,397,449 B1 * 6/2002 Mason et al. ..... 29/421.1
6,532,785 B1 * 3/2003 Gmurowski ..... 72/61

* cited by examiner

*Primary Examiner*—David B Jones

(57) ABSTRACT

A hydroforming seal and method includes a nozzle having both a radially expandable O-ring seal and a conical tapered surface for separately sealing with the bore of the tube. The O-ring seal is expanded to seal the tube and pressurized fluid is added sufficient to support the interior of the tube while the dies are closed so that the tube is thereby bent and forced into the die cavity without collapse or injury to the tube. The O-ring seal is then contracted to a non-sealing position and the conical tapered surface provides metal-to-metal sealing while the higher hydroforming pressure is applied to expand the tube. The nozzle also has a radial shoulder that engages the end face of the tube so that advance of the nozzle feeds the tube into the die.

10 Claims, 6 Drawing Sheets

TWO MODE HYDROFORM SEAL APPARATUS AND METHOD

FIELD OF THE INVENTION

The present invention relates to a hydroforming seal apparatus and method and more particularly a two mode hydroforming seal and method by which the hydroforming cycle time can be shortened while making high quality hydroformed tubes.

BACKGROUND OF THE INVENTION

It is well known in the prior art that a tube may be hydroformed to a desired complex tubular shape. The tube is placed between a pair of hydroforming dies having cavities which define the desired resultant shape of the tube. Pressurized hydroforming fluid is then introduced into the tube to expand the tube outwardly into the cavities.

It often occurs that the complex shape of the cavities require that the tube be preformed to an approximate shape of the cavities before the tube is placed into the dies. The prior art has recognized that the pre-forming of the tube can be avoided by positioning the tube between the dies and then filling the tube with fluid under a modest pressure so that the dies can then be closed and the pressure of the fluid residing within the dies will provide sufficient internal support to the tube walls to thereby prevent undesired collapse or other injury to the tube as the tube is forced into the cavities by the closing dies. Thus, although the pre-filling of the tube before closing the dies can avoid the necessity for pre-forming the tube, the hydroforming seals can be subjected to increased stress and wear which can cause an increase in machine down time for seal maintenance.

It is also well known that the complexity of the cavities in the hydroforming dies can result in the need to axially feed the tube into the die cavity as the hydroforming pressures are increased to expand the tube outwardly into the conformance with the complex shapes of the die cavity. This axial feeding under high pressure condition can also cause stress and wear on the seals.

In view of the foregoing, it would be desirable to provide further improvements in hydroforming seals and methods in order to achieve further improvements in the reliability of the sealing of the ends of the tubes as well as improved cycle times for the filling of the tube, and the closing of the dies, and the introduction of high pressure fluid and axial feeding of the tube into the complex shape of the dies.

A hydroforming seal and method includes a nozzle for insertion into the tube, the nozzle being a radially expandable O-ring seal for sealing with the bore of the tube, a conical tapered surface for sealing with the bore of the tube, and a radial shoulder for engagement with the end of the tube. The O-ring seal is expanded to seal the tube and pressurized fluid is added sufficient to support the interior of the tube while the dies are closed and the tube is thereby bent and forced into the die cavity without collapse or injury to the tube by the closing dies. The O-ring seal is then contracted to a non-sealing position and the conical tapered surface provides metal-to-metal sealing while the hydroforming pressure is applied to expand the tube outwardly into the die cavities and the end of the tube is axially fed into the die by the engagement of the radial shoulder with the end face of the tube.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is merely exemplary in nature and is not intended to limit the invention, its application, or uses.

Figure 1:
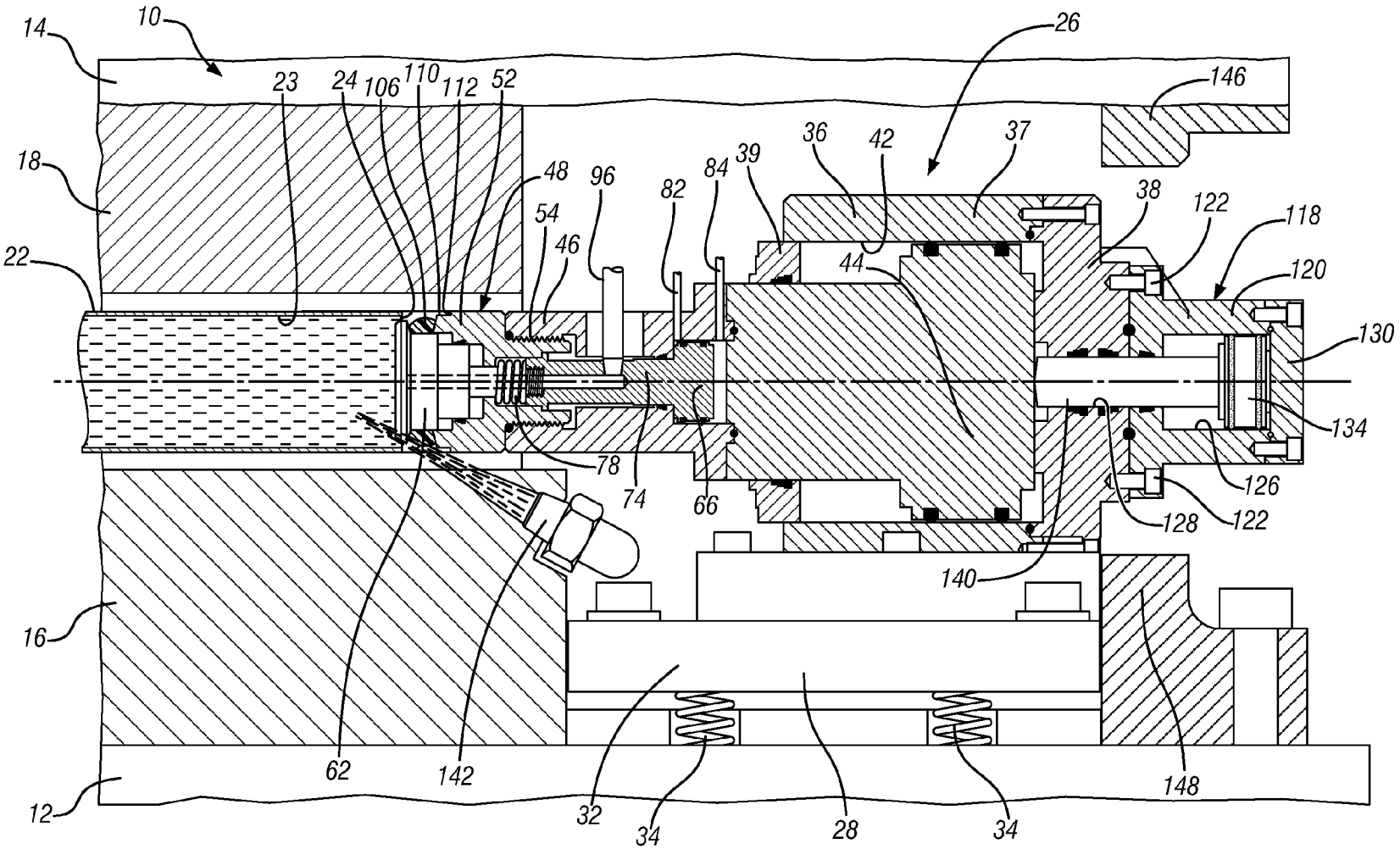
FIG. 1 is a side elevation view of a hydroforming apparatus according to the invention and showing the tube positioned between the dies and awaiting the insertion of a nozzle into the tube.

Referring to FIG. 1, a press 10 has a lower bed 12 that is stationary and an upper bed 14 that moves vertically. A lower hydroforming die 16 is mounted on the lower bed 12 and an upper hydroforming die 18 is mounted on the upper bed 14. In FIG. 1 the upper die 18 is raised and a robot or other mechanism has positioned a tube 22 between the upper die 18 and the lower die 16. The tube 22 has a bore 23 and an end face 24.

A seal unit, generally indicated at 26, is mounted on the lower bed 12 of the press 10 by an elevator mechanism 28 that includes an elevator base 32 supported on springs 34. The seal unit 26 has a housing 36 mounted on the elevator base 32 and made of a sleeve 37, right end cap 38 and left end cap 39 that are bolted or welded together. The housing 36 has a cylinder bore 42. A feed piston 44 slides inside the cylinder bore 42 and has a feed rod 46 attached to the feed piston 44 and extending toward the hydroforming dies 16 and 18. The feed rod 46 carries a nozzle unit, generally indicated at 48.

Figure 2:
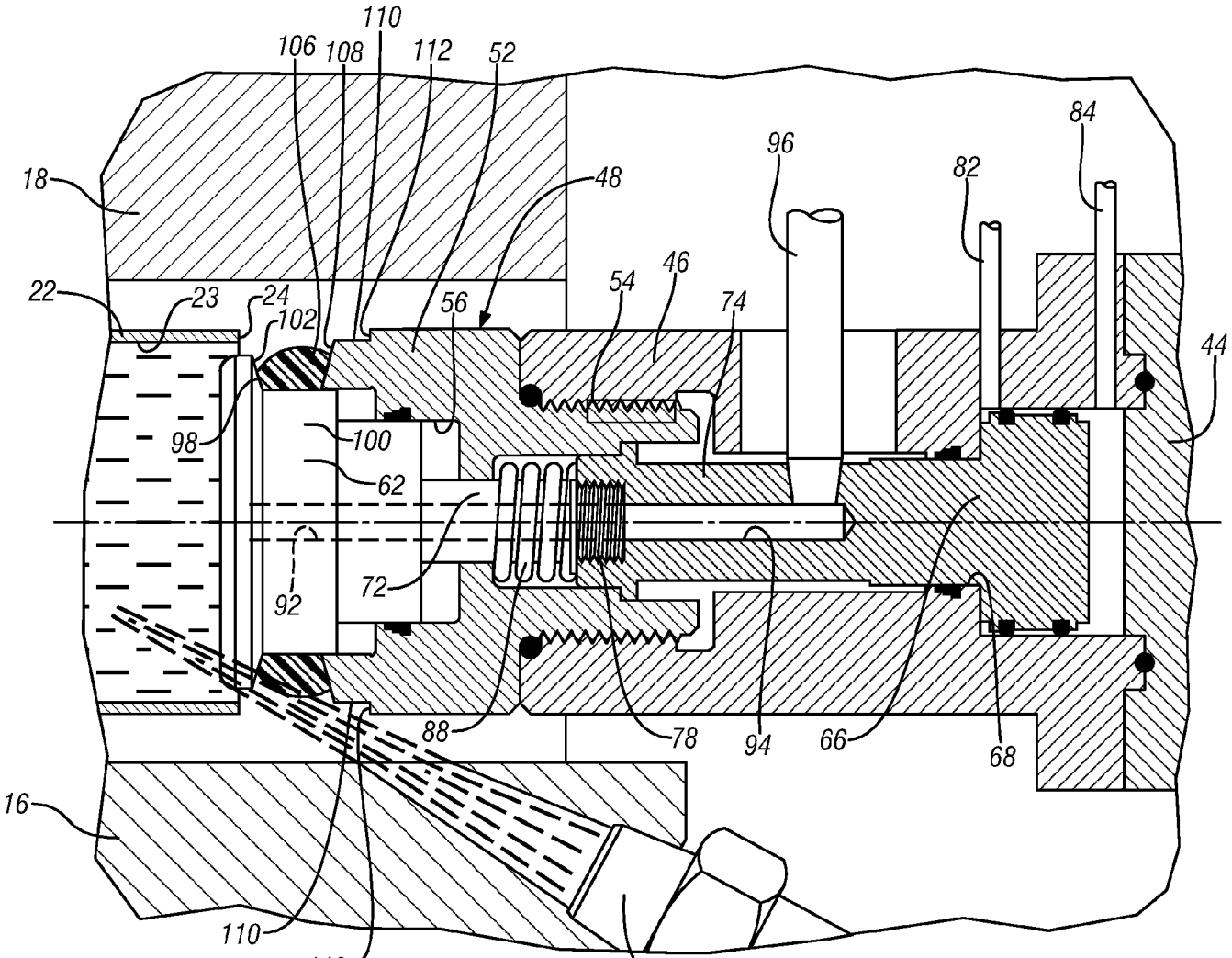
FIG. 2 is an enlarged fragmentary view of FIG. 1 showing the two seals carried by the nozzle, with the O-ring seal radially contracted.

The nozzle unit 48 is best seen in the enlarged view of FIG. 2 and includes a nozzle housing 52 that is attached to the end of the feed rod 46 by threads 54. Nozzle housing 52 has a stepped bore 56. A seal actuator 62 slides in the stepped bore 56 of the nozzle housing 52. A nozzle piston 66 slides in a stepped bore 68 of the feed rod 46 of feed piston 44. The seal actuator 62 has a stem portion 72 that is attached to a rod portion 74 of the nozzle piston 66 by threads 78 so that the seal actuator 62 and the nozzle piston 66 will move left and right in unison when hydraulic fluid is communicated to the fluid ports 82 and 84 located in the feed rod 46 on opposite sides of the nozzle piston 66. A coil compression spring 88 encircles the stem portion 72 of seal actuator 62 and acts between the nozzle housing 52 and the rod portion 74 of piston 66 to urge the seal actuator 62 rightwardly.

The seal actuator 62 has a central fluid bore 92 that communicates with a central fluid bore 94 provided in the rod portion 74 of piston 66. A pipe 96 is connected to the central fluid bore 94 so that hydroforming fluid can be introduced into the tube 22, as will be discussed in detail hereinafter.

The leftward end of the seal actuator 62 has a groove 98 formed by a cylindrical wall 100 and a conical ramp 102. An elastomeric o-ring seal 106 resides in the groove 98. The leftward end of the nozzle housing 52 has a conical ramp 108 that faces toward the conical ramp 102 of the seal actuator 62.

The leftward end of the nozzle housing 52 also has a cylindrical tapered seal surface 110 that is sized to be press fit into the end face 24 of the tube 22, and a radial shoulder 112 that will press against the end of the tube 22 when the cylindrical tapered seal surface 110 is pressed into sealing engagement with the bore 23 of the tube 22. As seen in FIG. 2, the elastomeric O-ring seal 106 is located closer to the end of the nozzle housing 52, so that the O-ring seal 106 is located more inside the tube than the cylindrical tapered seal surface 110.

Referring again to FIG. 1, the seal unit 26 also includes a positioning cylinder, generally indicated at 118, and having a housing 120 attached to the right hand end cap 38 of housing 36 by bolts 122. The housing 120 has a piston bore 126, a rod bore 128, and an end cap 130. A positioning piston 134 slides in the piston bore 126 and has a positioning rod 140 that slides in the rod bore 128 and engages with the feed piston 44. Housing 120 has hydraulic ports, not shown, by which the positioning piston 134 can be either shifted to the left to thereby move the feed piston 44 leftwardly, or, can be relieved of pressure so that the positioning piston 134 can be returned rightwardly by the feed piston 46 as will be discussed hereinafter.

OPERATION

Figure 3:
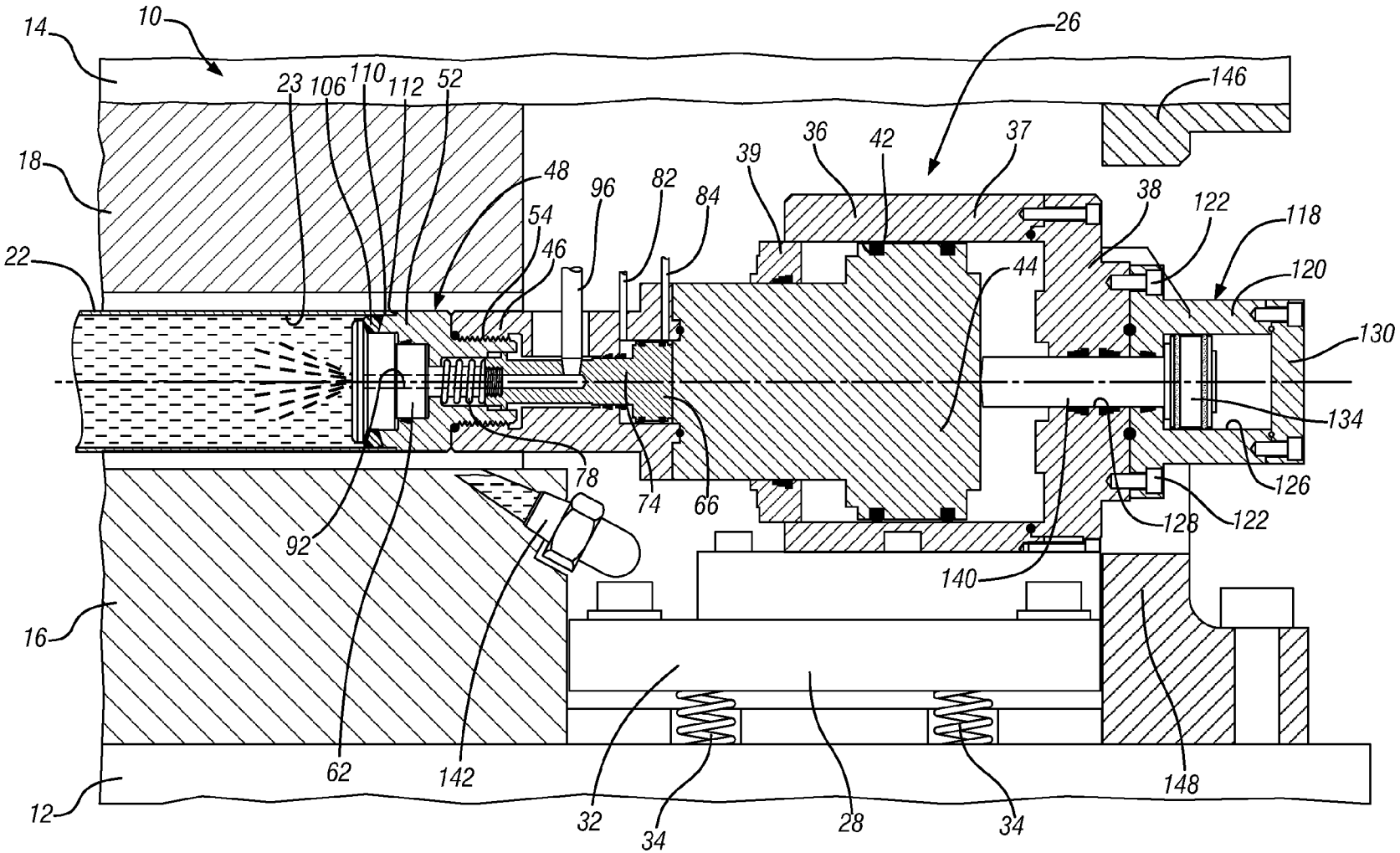
FIG. 3 is a view similar to FIG. 1 but showing the nozzle of the sealing unit having been inserted into the tube, and the O-ring seal radially expanded to engage with the bore of the tube.

In FIGS. 1 and 2, the dies 16 and 18 are open and the tube 22 is poised between the open dies by the robot. Hydroforming fluid, typically water, is sprayed into the tube 22 by a quick fill nozzle 142. When the tube 22 reaches a mostly filled condition, the positioning piston 134 is operated to move to the left from the position of FIG. 1 and thereby shifts the feed piston 44 to the left to the position in FIG. 3. As shown in FIG. 3, the nozzle unit 48 is in turn carried to the left with the feed piston rod 46 so that the nozzle unit 48 is inserted into the bore 23 of the tube 22.

Figure 4:
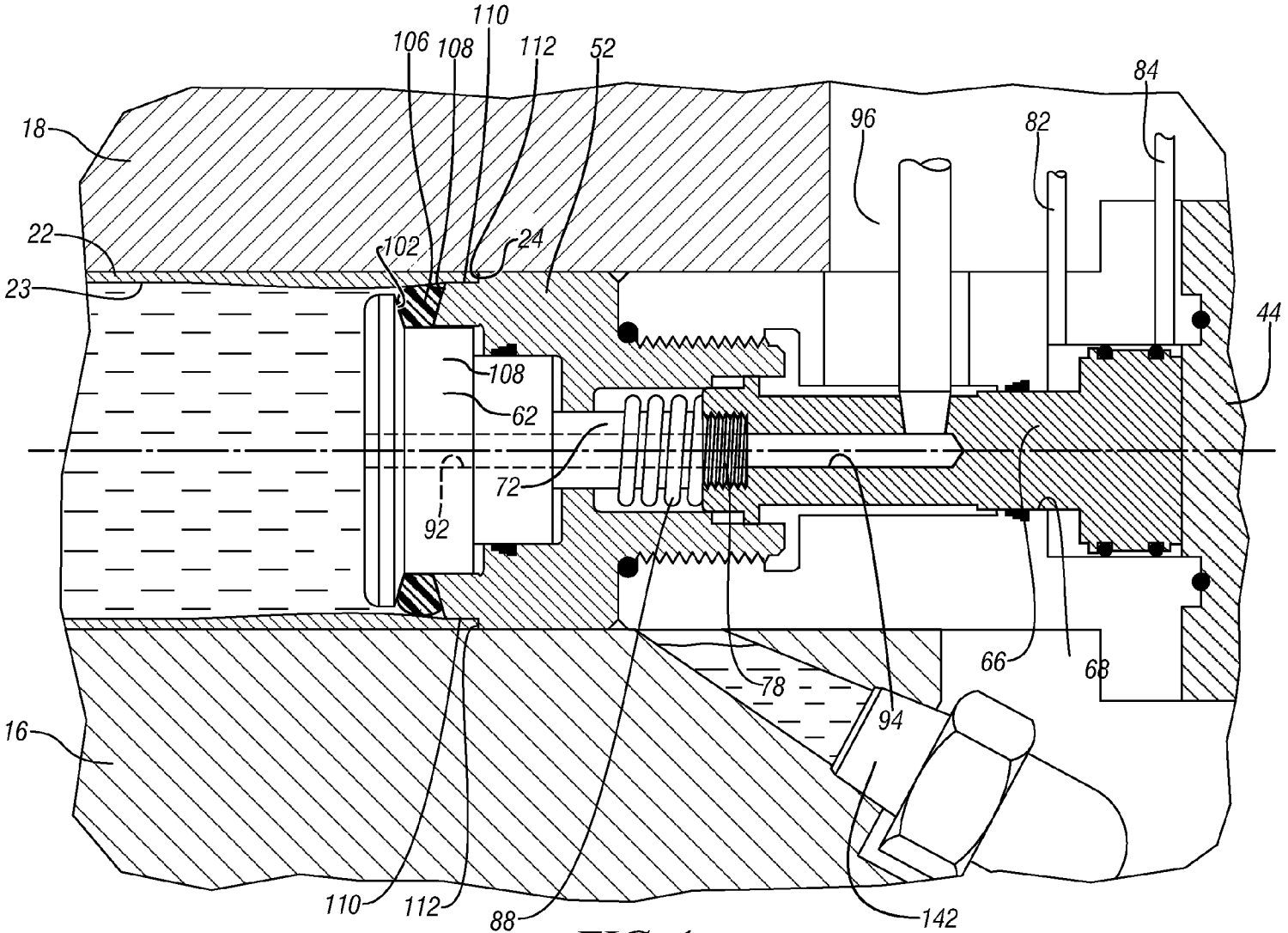
FIG. 4 is an enlarged fragmentary view of FIG. 3 showing the O-ring seal expanded to seal with the bore of the tube while the dies are closed about the conical tapered sealing surface thereof.

Also as seen in FIG. 3, the nozzle piston 66 is shifted to the right by communicating fluid pressure to the fluid port 82, which will in turn shift the seal actuator 62 rightwardly. As best seen in FIG. 4, rightward shift of the seal actuator 62 will cause the O-ring seal 106 captured between the conical ramp 102 of the seal actuator 62 and the conical ramp 108 of the nozzle housing 52 to be expanded radially outward and come into sealing engagement with the bore 23 of the tube 22. Then, as shown in FIG. 3, hydroforming fluid pressure is communicated through the pipe 96 and through the central bore 94 and the central bore 92 into the interior of the tube 22. Fluid pressure is applied at a level that is sufficient to support the interior of the tube 22 while the dies are closed.

FIG. 4 shows the dies having been closed about tube 22. In particular, as the upper bed 14 of the press 10 is lowered, the upper die 18 presses against the top of the tube 22 forcing the tube 22 downwardly into the lower die 16. Elevator mechanism 28 allows the seal unit 26 to move downwardly with the tube 22 as the tube 22 is lowered into the lower die. A block 146 attached to the upper bed 14 and a block 148 attached to the lower bed 12 engage with the seal unit 26 to prevent a rightward shifting of the seal unit 26. It will be understood that the presence of the pressurized hydroforming fluid within the tube 22 will provide internal support to the tube walls so that the closure of the dies can be employed to force and bend the tube 22 into the cavity of the dies without collapse, wrinkling or other injury of the tube 22. The level of pressure required during the closure of the dies to prevent the injury to the tube 22 is determined by multiple factors, such as the wall thickness of the tube, the intricacies of the cavity shape, the ductility of the tube material, etc. However, a typical pressure to be maintained in the tube by the expanded O-ring seal 106 is about 1,000-5000 pounds per square inch.

Figure 5:
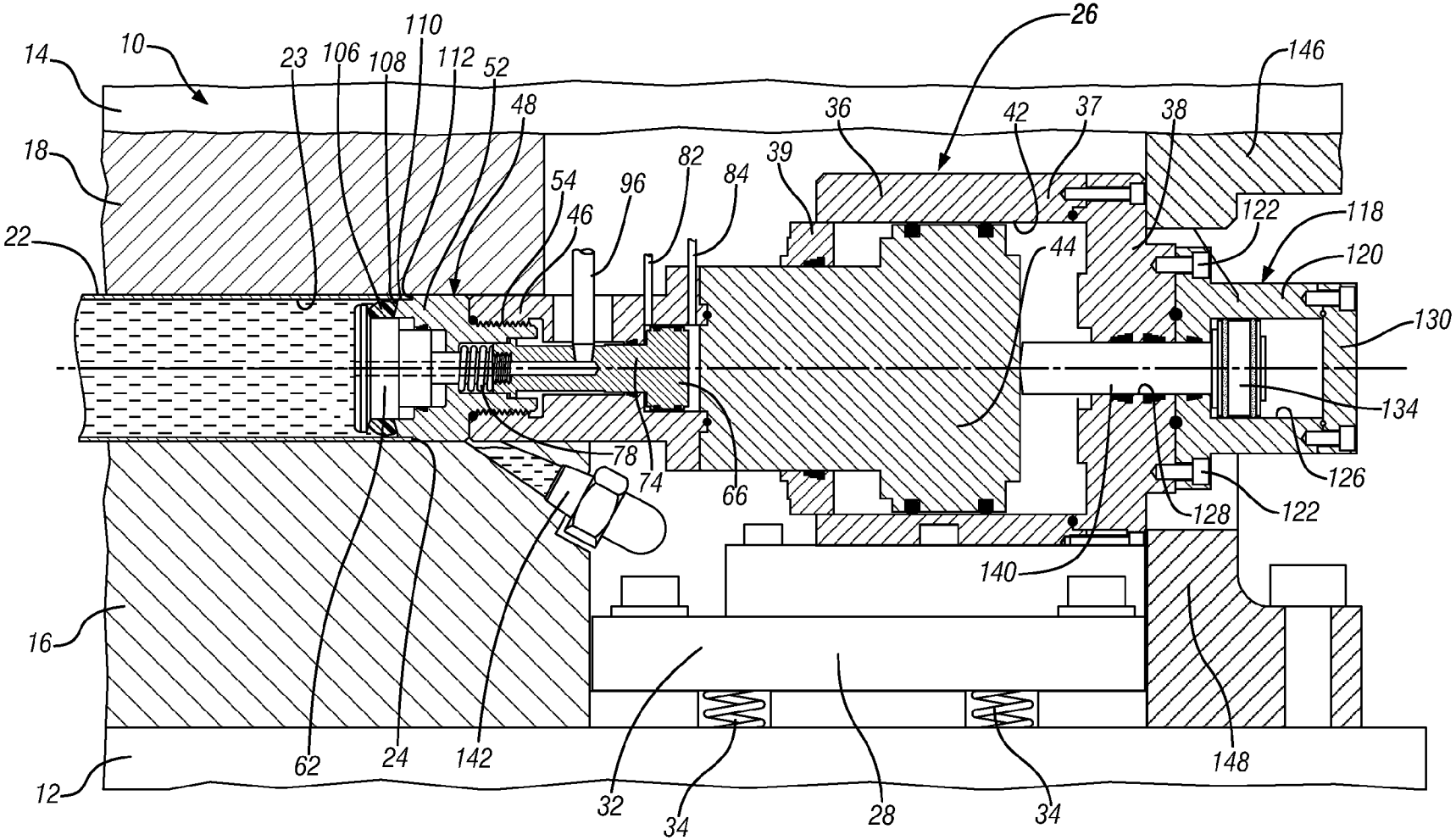
FIG. 5 shows the O-ring seal having been contracted to a non-sealing position relative to the tube and the tapered seal surface of the nozzle providing metal-to-metal sealing while high pressure fluid expands the tube outwardly into the die cavities.

As seen in FIG. 5, once the dies are closed, the nozzle piston 66 is again moved to the left by introducing fluid pressure at fluid port 84. The resultant leftward movement of the seal actuator 62 will allow the O-ring seal 106 to contract radially away from sealing engagement with the bore 23 of the tube 22. Although the O-ring seal 106 has thus been contracted and no longer serves a sealing function, it will be understood that the nozzle housing 52 has its tapered seal surface 110 engaged into the bore 23 of the tube 22, and its radial shoulder 112 engaged with the end face 24 of the tube 22 to thereby provide a metal-to-metal seal between the metal of the nozzle housing 52 and the metal of the tube 22. The tube 22 will next be hydroformed by steadily increasing the pressure of the hydroforming fluid to the range of 9,000 to 20,000 PSI during which the metal-to-metal seal provided by the tapered seal surface 110 will prevent the loss of fluid from the tube 22.

Figure 6:
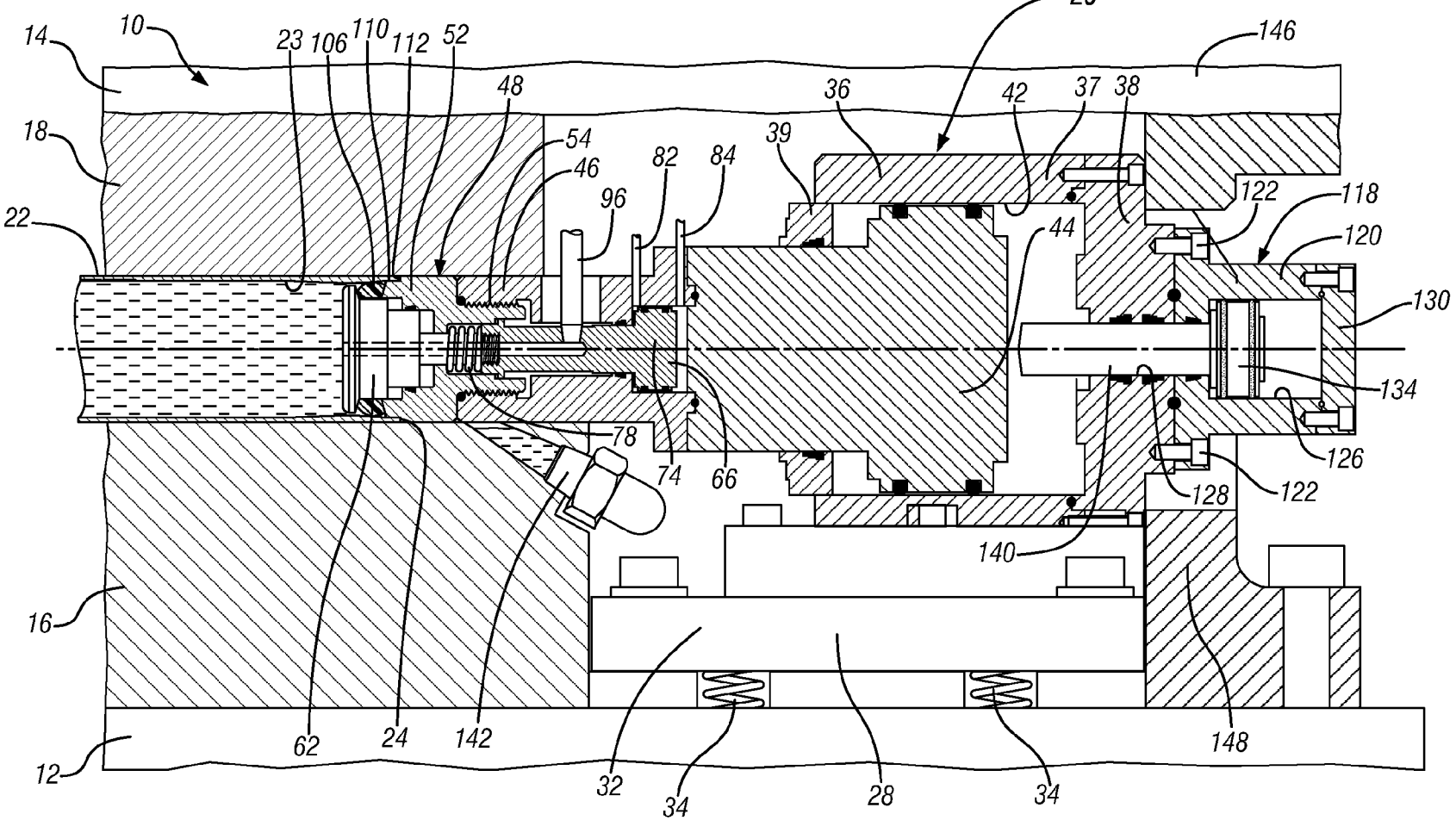
FIG. 6 is a view similar to FIG. 5 but showing the nozzle unit having been advanced axially into the dies so that the tube is fed axially into the die cavities during the high fluid pressure hydroforming of the tube.

As seen in FIG. 6, the hydraulic pressure provided on the feed piston 44 will be increased during the increase in hydroforming pressure so that the feed piston 44, and the feed rod 46 and the nozzle housing 52 will move progressively to the left and the end of the tube 22 can be axially fed into the dies by the engagement of the radial shoulder 112 of the nozzle housing 52 with the end face 24 of the tube 22.

Thus, it is seen that a dual mode nozzle has been provided in which an elastomeric O-ring seal is used to seal the end of the tube during the relatively lower fluid pressures needed to support the interior of the tube during the forced lowering of the tube 22 into the cavities of the hydroform dies 16 and 18. The metal-to-metal seal provided by the tapered conical seal surface 110 and radial shoulder 112 will be relied upon to seal the tube at the substantially higher fluid pressures that are required to hydroform and expand the tube into its final shape. By contracting the O-ring seal away from the tube during the high pressure hydroforming, the life of the O-ring seal can be substantially improved as it is not employed to obtain sealing at the relatively much higher pressures used in the hydroforming and axial feeding. During the closing of the dies, the O-ring seal 106 has sealing capability and a sufficient flexibility to accommodate some movement of the tube as it is force fed into the die cavities upon the closure of the upper die 18.

It will be understood that the particular metal-to-metal seal shown herein is just one example of the metal-to-metal seals known in the prior art, and that the invention herein is not limited to the particular example of a metal-to-metal seal shown herein. In some cases, the radial shoulder 112 will be stepped or otherwise shaped to effectively seal against the end face 24 of the tube.

What is claimed is:

1. Hydroforming apparatus for hydroforming a tube having a bore and an end face into the die cavity of hydroforming dies, comprising:

a nozzle housing having a tapered surface adapted to sealingly engage with the tube by press fit of the tapered surface into the bore of the tube and a radial shoulder for engagement with the end face of the tube so that the end of the tube can be axially fed into the hydroforming dies during hydroforming of the tube;

a seal actuator slidable inside the nozzle housing;

an elastomeric O-ring seal captured between ramp surfaces of the nozzle housing and the seal actuator so that sliding movement of the seal actuator will expand or contract the O-ring seal;

a nozzle piston for sliding the seal actuator to expand the O-ring seal into sealing engagement with the bore of the tube during the initial build up of fluid pressure in the tube and during the forcing of the tube into hydroforming dies during closure of the dies, and for sliding the seal actuator to contract the O-ring seal away from sealing engagement with the bore of the tube during the build up of hydroforming pressure inside the tube;

a feed piston for forcibly advancing the nozzle housing into the tube to axially feed the tube into the dies;

and a positioning piston for quickly advancing the feed piston to thereby quickly insert the nozzle housing into position inside the bore of the tube.

2. The apparatus of claim 1 further comprising the O-ring seal sealing with the bore of the tube at fluid pressures of about 1000 p.s.i. to provide internal support of the tube during forcing of the tube into the die cavities.

3. The apparatus of claim 1 further comprising the tapered surface sealing with the bore of the tube at fluid pressures up to about 6000 to 18,000 p.s.i.

4. The apparatus of claim 1 further comprising a quick fill nozzle for substantially filling the tube with fluid prior to shifting of the nozzle housing into the tube and expansion of the O-ring seal.

5. Hydroforming apparatus for hydroforming a tube having a bore and an end face, comprising:

a nozzle housing adapted for insertion into an open tube and having a tapered conical surface adapted to sealingly engage with the tube by press fit of the tapered conical surface into the bore of the tube to create a metal-to-metal seal between the nozzle housing and bore of the tube;

a seal actuator slidable inside the nozzle housing;

an elastomeric O-ring seal located on the nozzle housing to engage with the bore of the tube interiorly of the tapered conical surface, said O-ring seal being captured between ramp surfaces of the nozzle housing and the seal actuator so that sliding movement of the seal actuator will expand or contract the O-ring seal;

a nozzle piston for sliding the seal actuator to expand the O-ring seal into sealing engagement with the bore of the tube during the initial build up of fluid pressure in the tube and during the forcing of the tube into hydroforming dies during closure of the dies, and for sliding the seal actuator to contract the O-ring seal away from sealing engagement with the bore of the tube during the build up of higher hydroforming pressure inside the tube;

said nozzle housing having a radial shoulder engaging with an end face of the tube so that advancing the nozzle housing will feed the tube axially into the dies;

a feed piston for forcibly advancing the nozzle housing into the tube to axially feed the tube into the dies and a positioning piston for advancing the feed piston to quickly insert the nozzle housing into the bore of the tube.

6. The apparatus of claim 5 further comprising a quick fill nozzle for substantially filling the tube with fluid prior to shifting of the nozzle housing into the tube and expansion of the O-ring seal.

7. The apparatus of claim 5 further comprising the O-ring seal sealing with the bore of the tube at fluid pressures of about 1000 p.s.i. to provide internal support of the tube during forcing of the tube into the die cavities.

8. The apparatus of claim 5 further comprising the tapered surface sealing with the bore of the tube at fluid pressures up to about 6000 to 18,000 p.s.i.

9. The apparatus of claim 5 further comprising the O-ring seal sealing with the bore of the tube at fluid pressures of about 1000 p.s.i. to provide the internal support of the tube during forcing of the tube into the die cavities and the tapered surface sealing with the bore of the tube at fluid pressures up to about 6000 to 18,000 p.s.i.

10. The apparatus of claim 9 further comprising a quick fill nozzle for substantially filling the tube with fluid prior to shifting of the nozzle housing into the tube and expansion of the O-ring seal.

* * * * *